US005111678A

United States Patent [19]

Evans et al.

[11] Patent Number: 5,111,678

[45] Date of Patent: May 12, 1992

[54] ELECTRIC HEATER COIL TRANSFERRING AND FORMING APPARATUS AND METHOD OF USE

[75] Inventors: Arthur Evans, Sherburne; John R. McManus, Marcellus, both of N.Y.

[73] Assignee: Carrier Corporation, Syracuse, N.Y.

[21] Appl. No.: 705,835

[22] Filed: May 28, 1991

Related U.S. Application Data

[63] Continuation-in-part of Ser. No. 457,229, Dec. 26, 1989, abandoned.

[51] Int. Cl.[5] ..... B21C 47/00; B21D 43/10

[52] U.S. Cl. ..... 72/134; 72/422; 72/426; 29/759

[58] Field of Search ..... 29/173, 611, 759; 72/133, 134, 135, 137, 422, 426; 140/71.5, 89, 92.9, 103; 198/456

[56] References Cited

U.S. PATENT DOCUMENTS

| | | | |
|---|---|---|---|
| 2,254,525 | 9/1941 | Hathaway et al. | 140/92.9 |
| 4,147,048 | 4/1979 | Herckelbout | 72/137 |
| 4,236,397 | 12/1980 | Lange | 72/137 |
| 4,895,244 | 1/1990 | Flaugher et al. | 198/456 |

FOREIGN PATENT DOCUMENTS

| | | | |
|---|---|---|---|
| 45-6209 | 3/1970 | Japan | 140/89 |

*Primary Examiner*—Lowell A. Larson
*Assistant Examiner*—Michael J. McKeon

[57] ABSTRACT

A method and apparatus for forming an electric resistance heating coil of desired resistance that involves forming a straight helical coil and centering the formed coil for transfer to a first folding station for holding the straight helical coil into a U-shaped helical coil.

7 Claims, 5 Drawing Sheets

ELECTRIC HEATER COIL TRANSFERRING AND FORMING APPARATUS AND METHOD OF USE

BACKGROUND OF THE INVENTION

This application is a Continuation-In-Part of commonly assigned U.S. Pat. application No. 457,229 filed Dec. 26, 1989, now abandoned.

This invention relates generally to electric resistance heating coil assemblies, and more particularly to a method and apparatus for forming lengths of coils of desired dimensions and resistance, centering the formed coils for transfer to a first folding station, and folding the centered coil into a U-shaped helical coil. During manufacture, electrical resistance space heating assemblies of the type employing a coiled resistance element require various forming, moving, manipulating, and checking steps. Straight wire is formed into a helical coil, configured into a desired shape, secured to an insulated support rack, lugged with electrical connectors, and inspected for proper insulation and resistance characteristics. Commonly assigned U.S. Pat. No. 4,528,441 discloses different insulator designs and a scheme for manually securing the coil to the insulators. The scheme, however, was only suited for hand assembly and required manual manipulation for each attachment as the coil was wrapped around the support rack and the insulators deformed the coil to achieve attachment. Commonly assigned U.S. Pat. Nos. 4,807,488 and 4,827,602 disclose a method and apparatus for automatically installing a coiled heater element onto insulators. To date, however, there has been no equipment or apparatus which permits the efficient forming, folding, moving, and manipulating to be done efficiently and automatically without damage to the assembly. In moving and folding straight lengths of helical coils into generally U-shaped coils by hand, there is a potential for misalignment of the nichrome coil in the folding station, so that when the U-shaped coils are attached to a rack the desired resistance of the coil could increase due to stretching or short-out due to compressing adjacent windings together and cause the completed coil assembly to be rejected. No apparatus has been proposed that permits a formed length of coil cut to a desired length to be centered and, transferred to a folding station for folding the coil to the desired configuration prior to transferring the folded coil to an automatic rack assembly fixture.

Coils have been formed with a desired diameter and pitch using wire of a known diameter to form an electrical coil of required resistance. After the coil winder has formed a coil, the formed coil is manually moved to a folding station where an operator tries to center the coil length in the folding apparatus whereby the coil length is formed into a U-shaped coil with a short base length and two leg lengths. After the coil is folded into the U-shape it is again manually moved to a coil/rack assembly station to fix the coil to the insulators of a rack.

Thus, there is a clear need for an apparatus and method for transferring a formed coil of a desired straight helical length to a first folding station and centering the coil in the folding station without damaging the coil.

SUMMARY OF THE INVENTION

It is an object of the present invention to manufacture electrical resistance heating coil assemblies of desired length, diameter, and resistance while avoiding the draw backs of the prior art.

It is a further object of the present invention to provide a method and apparatus for centering and transferring a formed straight length of helical coil of different diameters, pitches, lengths and wire sizes from a forming station to a first folding station.

It is another object of the present invention to provide a method and apparatus which will centrally locate a straight length of helical coil of desired diameter, length, and resistance in a folding device to form a generally U-shaped helical coil.

These and other objects of the present invention are obtained by means of movable conveyor having supporting members or saddles which receive a coil which is not centered in the saddle about the longitudinal axis of the conveyor, and a centering device for centering the formed coil on the conveyor, and a transfer device which transfers the centered coil to a first folding station.

The various features of novelty which characterize the invention are pointed out with particularity in the claims annexed to and forming a part of the specification. For a better understanding of invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification and which reference numerals shown in the drawing designate like or corresponding parts throughout the same, and in which;

FIG. 2(*b*) is a cross-sectional elevational view taken along Line II—II of FIG. 2(*a*) with the coil shown off-centered prior to movement by the centering means;

FIG. 2(*c*) is a cross-sectional elevational view taken along Line II—II of FIG. 2(*a*) after the coil is centered by the centering means;

DESCRIPTION OF THE PREFERRED EMBODIMENTS

Figure 1:
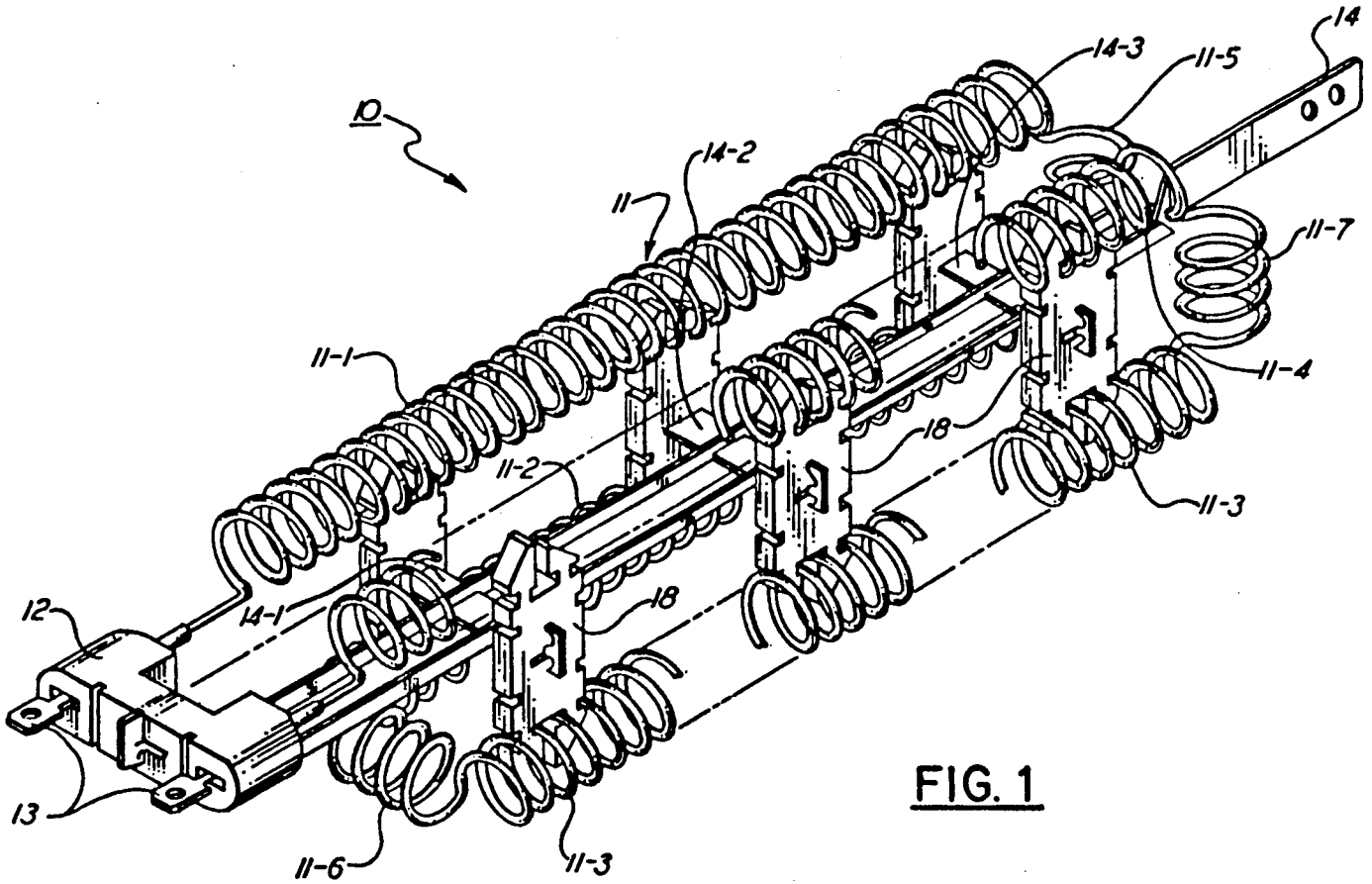
FIG. 1 is a perspective view of an assembled electrical resistance heating coil.

In FIG. 1, the numeral 10 generally designates an electric resistance heating coil assembly. The wire coil 11 is made up of four (4) long legs or branches 11-1 through 11-4 connected by short legs or branches 11-5 through 11-7 and terminates in spade lugs 13 separated by an end insulator block 12. Coil 11 is supported on a tree or rack 14 by a plurality of ceramic insulators 18 which are located on the ends of branches 14-1 through 14-3 of the rack.

In an electrical resistance space heating assembly the length, diameter, and pitch of the helically formed coil is critical in determining the desired resistance of the heating coil. In these heating assemblies adjacent coil windings must have proper spacing along the entire length of the coil, including the folds, to insure that the coil does not short-out and that both ends terminate in generally the same transverse plane. The sequential steps for centering, transferring, and folding a straight helical coil 11 into a generally U-shaped coil are illustrated in FIGS. 2–8. The key element in the folding process is a centering device 36 and transferring apparatus 34 which moves straight helical coil 11 from conveyor 30 and insures the proper locating of the straight helical coil 11 in the folding apparatus 40.

Figure 2A:
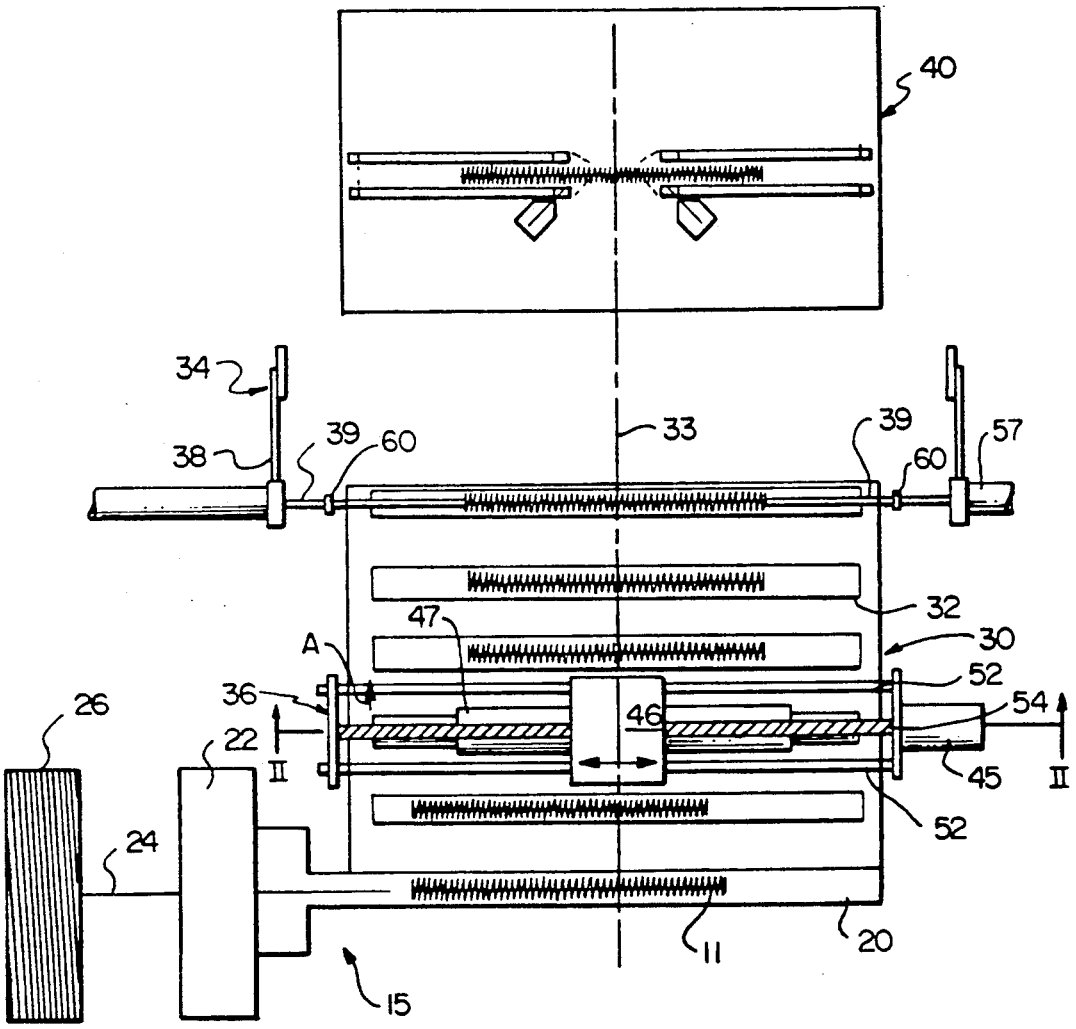
FIG. 2(*a*) is a schematic top plane view of a forming, centering and transferring, and folding apparatus according an embodiment of the present invention.
Figure 2B:
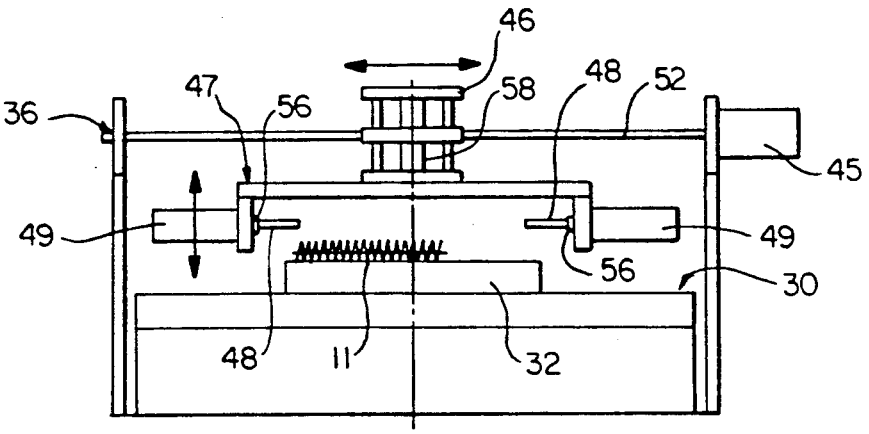
Figure 2C:
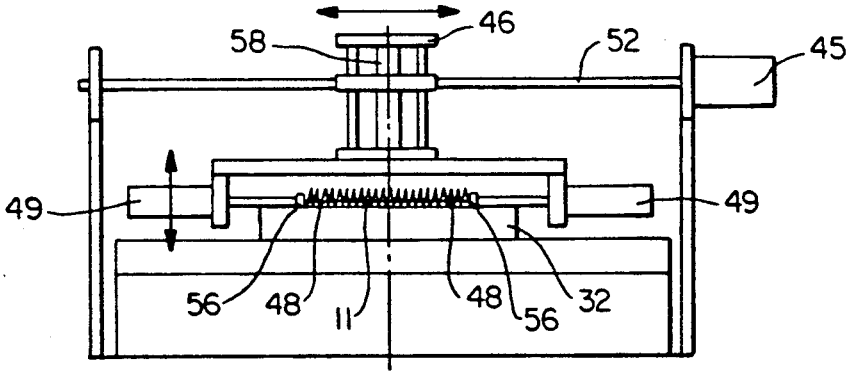

As shown in FIG. 2(*a*), the winding station 15 has a coil winder 22 which is fed straight wire 24 from wire spool 26. The adjustable coil winder 22 receives the straight wire 24 and helically winds the wire into coils 11 of desired diameter, pitch and length by cutting the wire with a blade or the like (not shown) when the desired coil length is reached. When the helical coil is fed onto a support trough 20, frictional forces may cause the windings of the coil to compress such that adjacent coils or windings are not spaced evenly along the length of the formed coil, i.e. improper pitch, and the coil is not centered in the trough 20. Therefore, when the formed straight helical coil 11 is transferred to endless belt conveyor 30, e.g. through a split bottomed trough and gravity feed, the coil will not be centered in supporting members or saddles 32 along the longitudinal axis 33 of the conveyor and folding apparatus and accordingly will not be centered in folding apparatus 40 if transferred by gravity from the conveyor 30. As shown in FIGS. 2(*a*) and 2(*b*) each singular coil 11 as initially received from the trough and placed on the conveyor is not centered about the longitudinal axis 33 but are displaced (as shown) to the left of the axis due to the friction between the coil and the trough. Thus, to solve this problem, as the endless belt conveyor 30 moves in the direction of the arrow A, each formed coil 11 prior to reaching the end of the conveyor adjacent the forming station 40, is centered in the saddles 32, as shown in FIG. 2(*c*) by centering device 36 and at the end of the conveyor is transferred to folding station 40 by transferring device 34. The centering device 36 includes a pair of Thompson bars or machined rods 52 and a rotating jacking device or Thompson screw 54 for supporting and moving a carriage 46 transverse to the axis. The Thompson screw is driven by motor 45. Carriage 46 has a zero position at the axis 33 and gripping means 47 including two movable rods 48 slideable into the coils without touching the sides of the coil during movement. The movable rods 48 are moved by the pistons 49 for gripping an off centered coil and moving it to center it at the zero position at the axis 33 so that generally equal lengths of coil are located on each side of the axis 33. The gripping means 47 is also moved vertically by the carriage 46, which can be operated by piston 58, in a manner to position the two movable rods 48, which are activated by pistons 49, into the ends of the off-centered coil. After the rods 48 are positioned within the coil, between adjustable stops 56 which are adjusted to provide the exact length of the coil between stops 56, the carriage 46, and thus the gripping means 47 and coil 11 are moved vertically upward and then horizontally to the zero position at the axis 33 and then vertically downward as shown in FIG. 2(*c*) whereby the coil 11 is centered in the saddles 32. It is important that the coil 10 avoid being unnecessarily deformed due to pulling or pushing on the coil as this can stretch or compress the coil and thereby cause improper numbers of windings to be located on the legs or base of the U-shaped coil, can cause a drawing of the wire when folded with a resultant localized increase of resistance, or the wire of the coil can be shorted-out or broken as the straight length helical coil is folded into the U-shaped coil. To avoid these problems, it is necessary to center the coil in the folding station 40 so that little, if any, changes of the coil resistance occur in folding the straight helical coil into a U-shaped coil. Transferring apparatus 34, includes a pair of pivotal arms 38 having movable rods 39, activated by pistons 57, which slide into and out of the ends of the centered coil for supporting the coil during transfer to the folding station 40. The movable rods have adjustable stops 60 which are adjusted to provide the exact length of the coil between stops 60.

Figure 3:
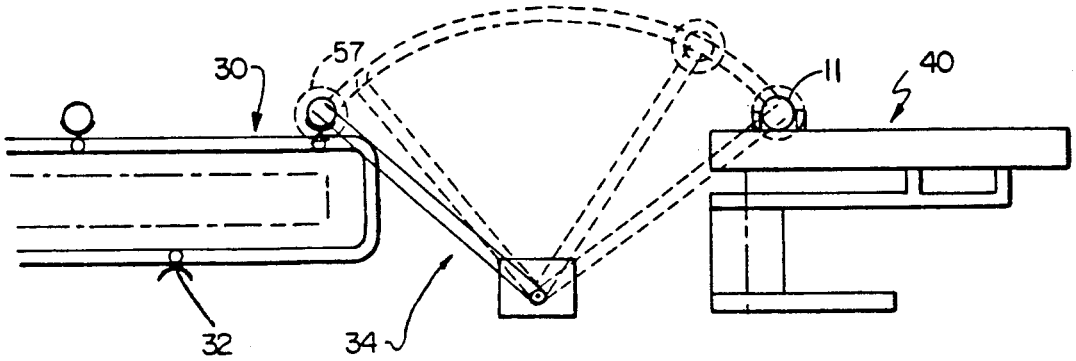
FIG. 3 is a schematic side elevation of the centering and transferring, and folding apparatus of FIG. 2(*a*)

FIG. 3 represents, in a schematic fashion, a technique for transferring a centered straight length helical electrical resistance heating coil 11 of desired dimensions from conveyor 30 to a folding station 40. The coil winder 22 forms the coil 10 and deposits the formed coil in the receiving trough 20. After a coil 11 of desired length is made, cut and in position in the trough 20, the bottom of the trough opens (not shown) and the coil 11 is moved to a position on saddle 32 on the endless conveyor 30. Generally, as a formed coil 11 is deposited on one end of the conveyor 30 a previously formed coil, having been centered in a saddle 32, is removed from the other end of the conveyor 30 and moved into the folding station 40.

Figure 4:
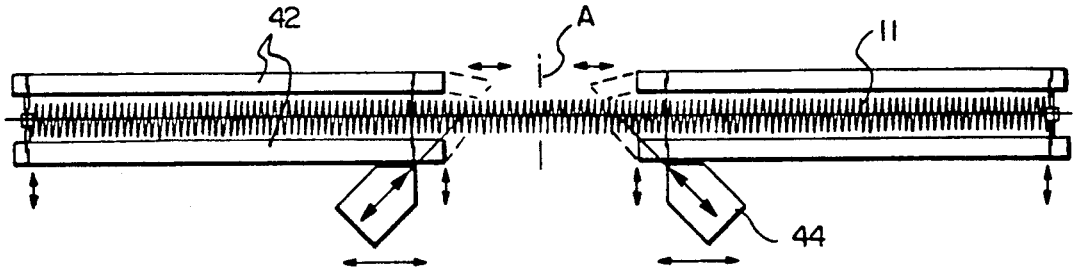
FIGS. 4–8 sequentially show the adjustable folding apparatus for FIG. 3, as viewed from above.
Figure 5:
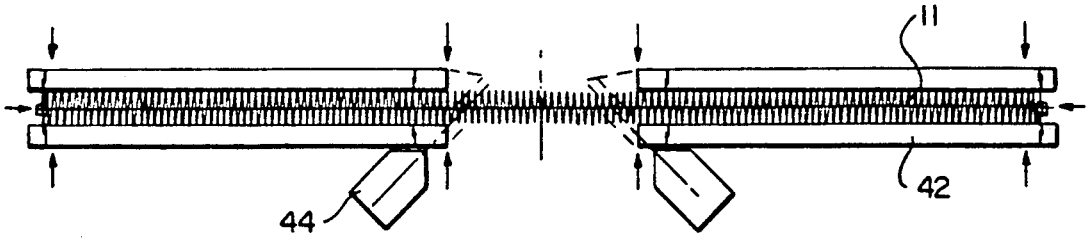
Figure 6:
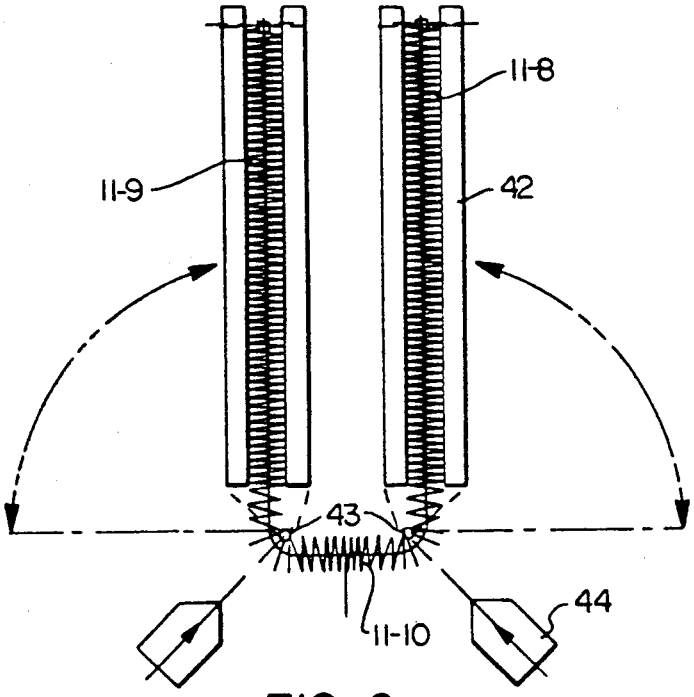
Figure 7:
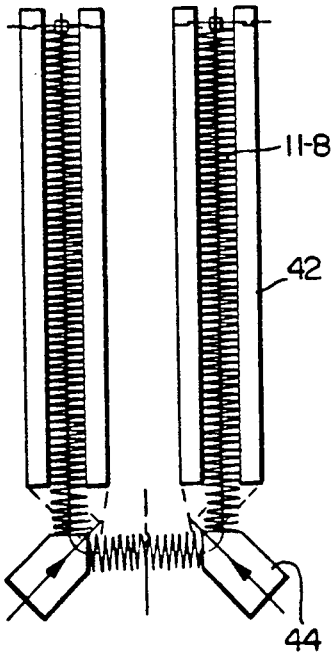
Figure 8:
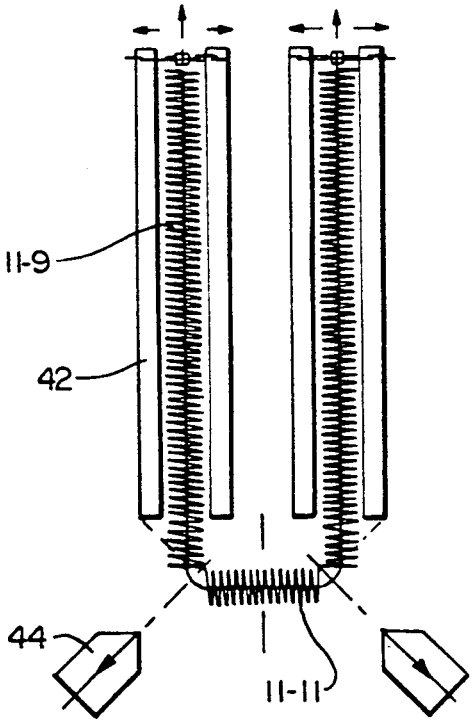

A practical embodiment of the folding apparatus 40 of this invention and its operation is shown in greater detail with reference to FIGS. 4–8. In the folding operation, the straight helical coil 11 is positioned between a pair of adjustable gripping plates 42 and transversely centered in the folding apparatus along center line 33. The gripping plates 42 are adjustable along the longitudinal length of the coil and around the diameter of the coil as shown by the arrows. Further, the folding apparatus 40 includes a pair of blades 44 for separating the coil windings at the junction between the leg portions and the bottom portion of U-shaped coil. The blades 44 can generally be a wedged shape device with a 90° tip for providing the proper separation of the coil windings during forming. After the transfer device 34 places the straight helical coil 11 between the gripping plates 42 of the forming apparatus as illustrated in FIG. 4, the gripping plates are moved against the leg portions of the coil to support the coil during the bending operation when the U-shaped coil is formed. After the straight length coil 11 is gripped by the gripping plates 42 as illustrated in FIG. 5, the gripping plates are rotated to the FIG. 6 position thus forming a generally U-shaped coil having generally straight leg portions 11-8 and 11-9 and a base portion 11-10 generally perpendicular to the leg portions 11-8 and 11-9 In the folding operation, where the gripping plates 42 and the portions of the straight coil forming the leg portions 11-8 and 11-9 are moved from FIG. 5 to FIG. 6 the inside portion of the windings at 43 are generally touching whereas the outside portion of the same windings are stretched apart. Accordingly, it is important that the windings between the base portion 11-10 and the leg portions 11-8 and 11-9 are located properly to avoid changes in resistance of the coil. In the FIG. 7 position, a pair of blades 44 are inserted into the coil at the junction between the base portion and leg portions to cause the windings to be properly located on the leg and base portions. In the FIG. 8 position, illustrated leg portions 11-8 and 11-9 and base portion 11-10 are properly formed after the blades 44 are returned to their starting position and the gripping plates 42 release the leg portions 11-8 and 11-9.

Figure 9:
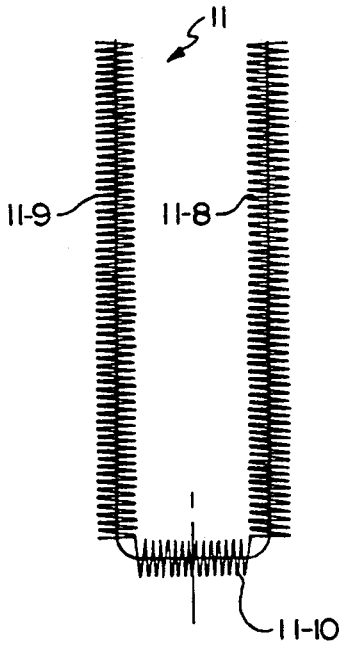
FIG. 9 is a folded coil prior to completion of an electric resistance heating coil assembly as shown in FIG. 1.

FIG. 9 is a view of a properly formed U-shaped helical coil with properly spaced windings in the leg portions and base portions thereby avoiding the problems in the prior art.

While a preferred embodiment of the present invention has been depicted and described, it would be appreciated by those skilled in the art that many modifications, substitutions, and changes, for example, an axially movable transfer device, may be made thereto without departing from the true spirit and scope of the invention.

What is claimed is:

1. An apparatus for centering a straight length helical electric resistance heating coil in a manufacturing station comprising;

a movable support means for receiving a singular straight length helical electric resistance heating coil thereon in a manner wherein said singular straight length helical electric resistance heating coil is positioned generally transverse to an axis of movement of said support means wherein unequal lengths of said singular straight length helical electric resistance heating coil are positioned on each side of said axis of movement of said support means, said support means includes a plurality of individual saddle members for supporting said singular straight length helical electric resistance heating coil during movement of said support means, centering means for gripping each singular straight length helical electric resistance heating coil having said unequal lengths positioned on each side of said axis of movement of said support means and positioning generally equal lengths of said singular straight helical electric resistance heating coil on each side of said axis of movement of said support means, said centering means includes movable rod means insertable into each end of the singular straight length helical electric resistance heating coil to hold said coil during centering; and transfer means for gripping a portion of said singular straight length helical electric resistance heating coil centered about said axis of movement of said support means and releasably transferring said singular straight length helical electric resistance heating coil to a second station.

2. An apparatus as set forth in claim 1 wherein said movable rod means have stop means, said stop means having adjusting means for adjusting the distance between said stop means to the length of said coil.

3. An apparatus as set forth in claim 1 wherein said transfer means includes a pair of movable support means insertable through each end of the singular straight length helical electric resistance heating coil for supporting an inner portion of the coil in a centered position with respect to the axis of movement of said support means during movement of said coil from said support means to said second station.

4. An apparatus as set forth in claim 3 wherein said pair of movable support means includes stop means, said stop means having adjusting means for adjusting the distance between said stop means to the length of said coil.

5. An apparatus as set forth in claim 1 wherein said second station includes a folding means for manipulating the singular straight length helical electric resistance heating coil into a generally U-shaped helical electric resistance heating coil.

6. An apparatus as set forth in claim 5 wherein said folding means includes clamping fixture having a pair of coacting walls arranged to open and close about end portions of said singular straight length helical electric resistance coil wherein, said pair of coacting walls are pivotable with respect of each other.

7. A method of centering a straight length helical electric resistance heating coil in a manufacturing station comprising the steps of:

locating the straight length helical electric resistance heating coil in a movable support means having a plurality of saddle members for supporting a singular straight length helical electric resistance heating coil thereon during movement of said movable support means in a manner to position said singular straight length helical electric resistance heating coil generally transverse to an axis of movement of said support means wherein unequal lengths of said singular straight length helical electric resistance heating coil are on each side of said axis of movement of said support means, inserting movable rod means into each end of said singular straight length helical electric resistance heating coil having unequal lengths on each side of said axis of movement of said support means, and positioning equal lengths of said coil on each side of the said axis of movement of said support means to center said coil about said axis, and gripping said centered coil on the inner length of said coil with second movable rod means, and moving said centered and gripped coil to a second manufacturing station.

* * * * *